United States Patent [19]

Sayer

[11] Patent Number: 4,831,804

[45] Date of Patent: May 23, 1989

[54] WINDOW FRAME APPARATUS

[75] Inventor: Bertram Sayer, Princeton, N.J.

[73] Assignee: Thermal Profiles, Inc., Keasbey, N.J.

[21] Appl. No.: 97,953

[22] Filed: Sep. 17, 1987

[51] Int. Cl.[4] ..... E04C 2/38

[52] U.S. Cl. ..... 52/475; 52/656; 52/824

[58] Field of Search ..... 52/822–825, 52/772–776, 204, 308, 656, 657, 475–477, 824; 49/501, DIG. 1, DIG. 2

[56] References Cited

U.S. PATENT DOCUMENTS

| | | | |
|---|---|---|---|
| 2,642,632 | 6/1953 | Savage | 52/775 |
| 3,388,517 | 6/1968 | Wohl et al. | 52/403 |
| 3,411,247 | 11/1968 | Fleming | 49/501 |
| 3,455,080 | 7/1969 | Meadows | 52/716 |
| 3,899,858 | 8/1975 | Zanker | 52/475 |
| 4,320,609 | 3/1982 | Abell | 52/824 |
| 4,624,091 | 11/1986 | Biro | 52/656 |
| 4,640,078 | 2/1987 | Haffer | 52/656 |

*Primary Examiner*—James L. Ridgill, Jr.
*Attorney, Agent, or Firm*—Bernard Malna

[57] ABSTRACT

A window frame apparatus includes flat metal inserts which are inserted into hollow plastic members which form a frame. The metal inserts are disposed so that the direction of maximum resistance to bending opposes the direction of wind loading, thereby providing a light-weight yet relatively stiff apparatus.

17 Claims, 4 Drawing Sheets

FIG. 3
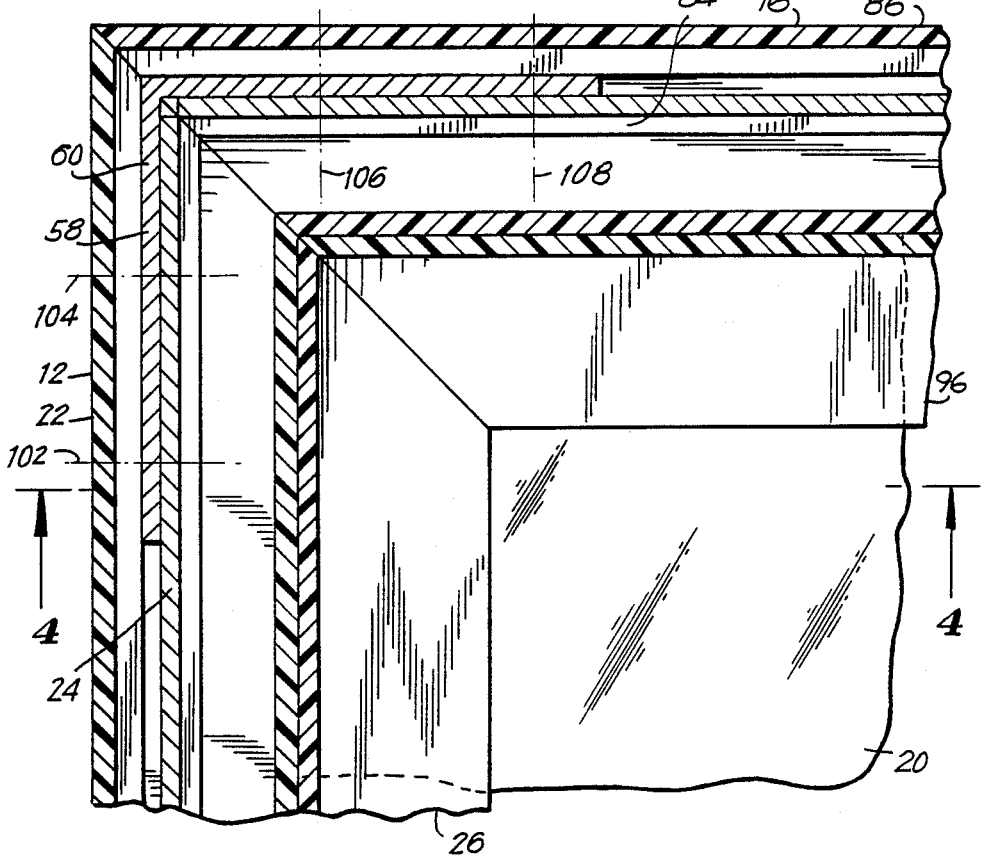
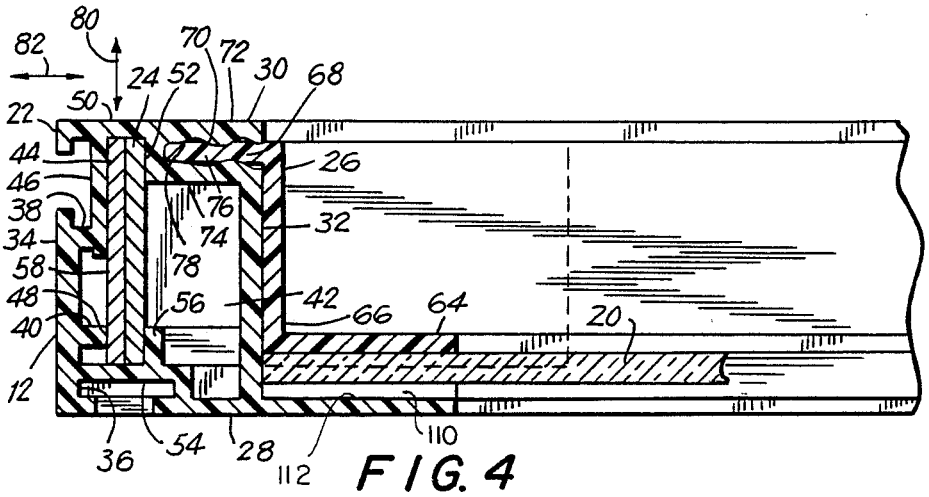
FIG. 4

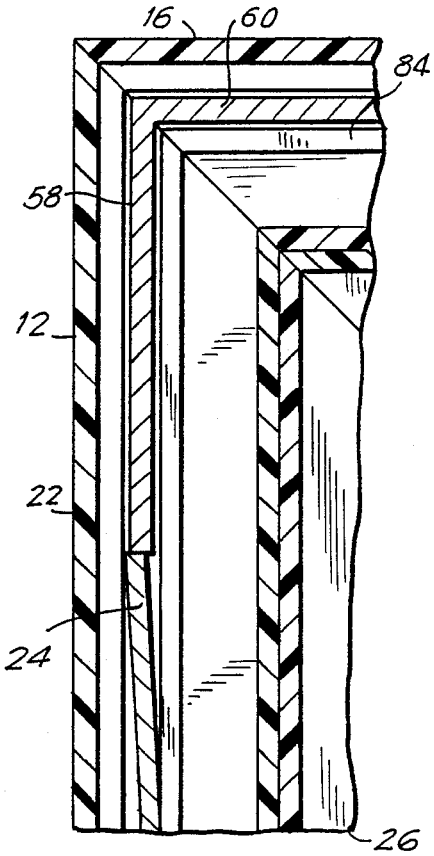
FIG. 5
FIG. 6
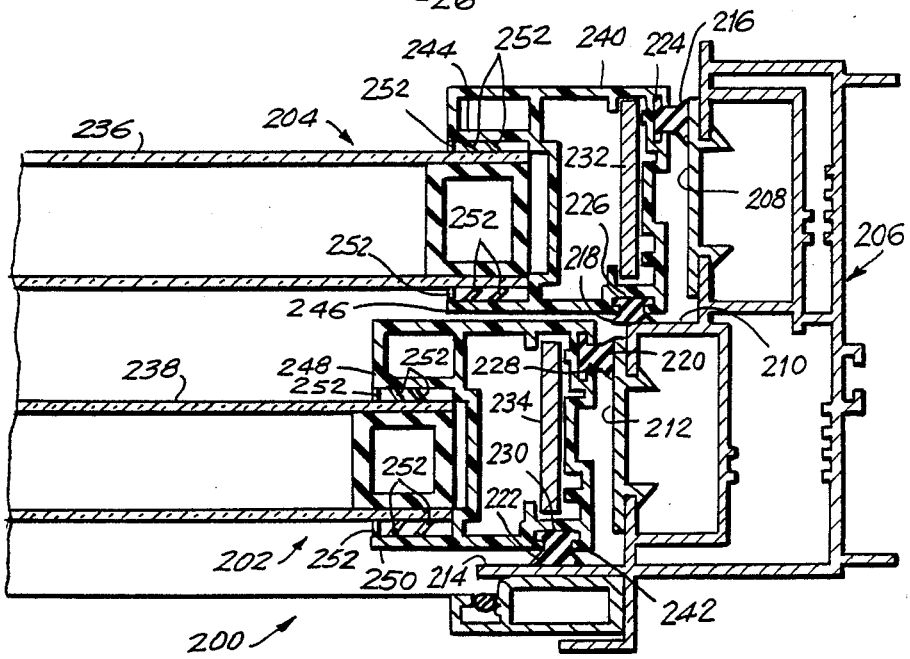

WINDOW FRAME APPARATUS

BACKGROUND OF THE INVENTION

The prior art related to the development of plastic window frames includes the use of metal stiffeners located within the hollow portions of the window sashes. The window sashes are usually formed of an extrudable plastic such as vinyl. Conventionally, the metal stiffeners are extruded or roll formed members which are shaped to fit the form of the hollow window sashes. The conventional metal stiffeners are shaped to conform to the walls of the hollow window sashes and comprise a relatively large portion of the overall weight of the window frame.

The disadvantages of the conventional vinyl window sashes which utilize the extruded or roll formed metal stiffeners includes the extensive heat conduction path which is provided by the walls of the metal stiffeners. This disadvantage is especially significant since it tends to degrade the thermal insulating properties of the vinyl window sash which is one of the primary advantages of this type of plastic window frame construction.

Another disadvantage of the conventional vinyl window apparatus is the complex and costly tooling required to fabricate conventional metal stiffeners which contributes toward the relatively high cost of a conventional vinyl window.

OBJECTS OF THE INVENTION

It is an object of the present invention to provide a plastic window frame which does not require an extruded or roll formed metal stiffener.

Another object of the present invention is to provide a plastic window frame which utilizes a flat metal stiffener.

Another object of the present invention is to provide a plastic window frame apparatus which uses a minimum amount of metal in order to maximize the thermal insulation provided by the apparatus.

Another object of the present invention is to provide a vinyl window frame which utilizes flat metal inserts to selectively provide structural stiffness in the direction of the wind load.

Another object of the present invention is to provide a window frame apparatus which is relatively light in weight.

Still another object of the present invention is to provide a vinyl window frame apparatus which utilizes a low cost simple metal insert, thereby providing a relatively low overall cost of construction.

SUMMARY OF THE INVENTION

In accordance with the present invention, there is provided a plastic window frame apparatus which utilizes flat metal inserts to enhance the structural characteristics of the apparatus in the direction of the wind loading. The plastic window frame apparatus includes a plastic sash, which is made of an extrudable plastic, such as vinyl, and which includes a recessed portion which is adapted to accept a glass window pane, and a hollow portion which is proportioned to accept a flat metal insert. The length of the insert is substantially equal to the vertical and horizontal members known as stiles and rails, respectively, which form the sash assembly.

The metal insert has substantially different resistance to bending depending on whether the applied force is applied perpendicularly to the flat portion of the insert or perpendicularly to the edge of the insert. The resistance to bending when the force is applied perpendicular to the edge of the insert is substantially greater than when the force is applied perpendicular to the flat portion of the insert. The vinyl sash is configured to hold the metal insert in a manner such that the wind force, which is generally perpendicular to the plane of the window pane, acts on the edge of the metal insert, thereby presenting the highest degree of bending resistance.

BRIEF DESCRIPTION OF THE DRAWINGS

Additional objects and advantages of the invention will become apparent during the course of the following specification when taken in connection with the drawings in which:

FIG. 3 is a cross-sectional view taken along the line 3—3 of FIG. 1;

FIG. 4 is a cross-sectional view taken along the line 4—4 of FIG. 3;

FIG. 5 is a cross-sectional view of an alternative embodiment of the invention;

FIG. 6 is a fragmentary perspective view of another alternative embodiment of the invention;

DETAILED DESCRIPTION OF THE INVENTION

Figure 1:
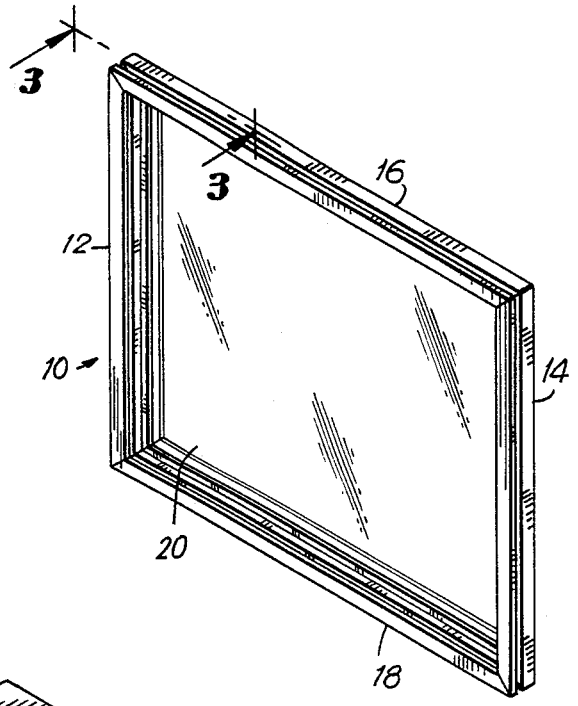
FIG. 1 is an overall perspective view of a window frame apparatus made in accordance with the present invention.

With reference to the drawings there is shown in FIG. 1 a window frame apparatus 10 which comprises two vertical 12, 14 and two horizontal 16, 18 elongated members and a pane of glazing material 20 which is mounted in and retained by the four elongated members 12, 14, 16, 18. The window frame apparatus 10 is typically mounted in a jamb assembly which in turn is mounted in a building structure. The jamb assembly is conventional in nature and well known and therefore has not been shown. The vertical members 12, 14 are conventionally known as stiles and the horizontal members 16, 18 are conventionally known as rails.

The vertical and horizontal elongated members 12, 14, 16, 18 are identical in configuration and differ only in length and therefore only the construction of the vertical member 12 will be described in detail.

Figure 2:
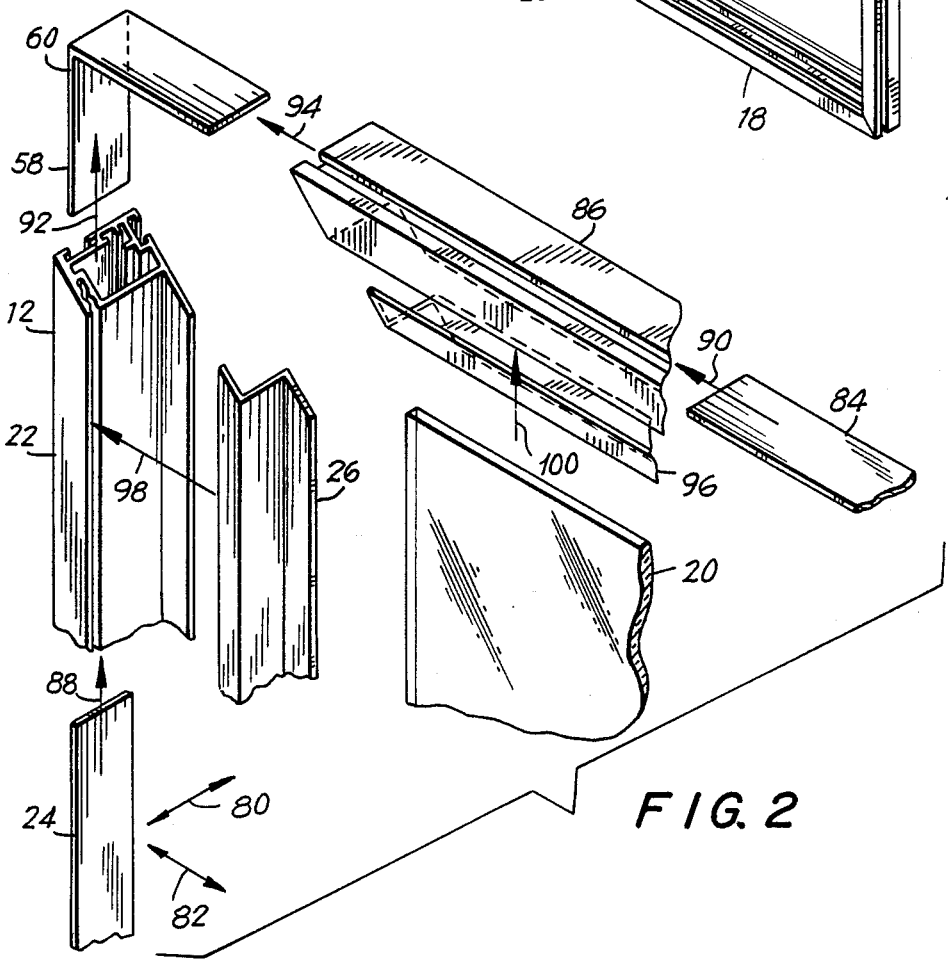
FIG. 2 is an exploded view of one corner of the window frame apparatus of FIG. 1.

The elongated member 12 as is best shown in FIGS. 2 and 4, comprises a hollow member 22, a metal stiffener 24, which forms a major novel feature of the present invention, and a glazing bead member 26. The hollow member 22 includes a front wall 28, a rear wall 30, an inner wall 32, and an outer wall 34. The front wall 28 and the outer wall 34 have recessed grooves 36, 38. The recessed grooves 36, 38 are proportioned to accept conventional strips of insulating material, which are not shown. The outer wall 34 has a projecting rib 40 which projects into the hollow portion 42 of the hollow member 22 to a depth such that the surface 44 of the portion 46 of the outer wall 34 and the end 48 of the rib 40 define a common plane. The portions 50, 52 of the rear wall 30, the portions 54 and 56 of the front wall 28, the portion 44 of the outer wall 34, and the end 48 of the rib 40 define a space which is proportioned to receive the metal stiffener 24 and the leg 58 of the corner gussett 60.

As is shown in FIG. 2, the metal stiffener 24 is a rectangular metal member which, as shown in FIG. 4, has a rectangular cross-section. The corner gussett 60 has legs 58 and 62, the cross-sections of which are similar to the cross-section of the metal stiffener 24.

The glazing bead member 26 has a first leg 64 which bears on the pane of glazing material 20 and urges the pane of glazing material 20 against the front wall 28 of the hollow member 22. A second leg 66 of the glazing bead member 26 abuts the inner wall 32, and a third leg 68 of the glazing bead member 26 projects into the convoluted groove 70 which is formed by the portions 72, 74 of the rear wall 30. The third leg 68 has convolutions 76 which complement the convolutions 78 of the groove 70, and the third leg 68 and the groove 70 are proportioned so that the third leg 68 fits tightly into the groove 70, thereby retaining the pane of glazing material 20 in a secure manner, yet enabling the pane of glazing material 20 to be removed and replaced if it becomes damaged or broken.

As is best shown in FIG. 4, the metal stiffener 24 is positioned so that the maximum resistance to bending is in the direction shown by the arrow 80 which is perpendicular to the pane of window glazing 20. This is the direction which sustains the maximum wind loading. The minimum resistance to bending of the metal stiffener 24 is in the direction shown by the arrow 82. A high degree of resistance to bending in this direction is not needed since it is parallel to the direction of the wind force.

The apparatus 10, according to the present invention, is assembled by inserting the metal stiffeners 24, 84 into the hollow members 22, 86 in the directions shown by the arrows 88, 90 in FIG. 2. The hollow members 22, 86 are then joined by sliding them onto the corner gussett 60 in the directions shown by the arrow 92, 94. The pane of glazing material 20 is put into place and the glazing beam members 26, 96 are inserted into the grooves 70 by pressing them onto the hollow members 72, 86 in the directions shown by the arrows 98, 100. The pane of glazing material 20 bears on a layer of flexible bedding compound 110 which has been deposited on the surface 112 of the front wall 28. The bedding compound 110 may be in the nature of a silicone adhesive or, alternatively, a thin foam strip, the surfaces of which have been coated with an adhesive layer. The flexible bedding compound 110 adheres the pane of glazing material 20 to the front wall 28 and the flexibility of this compound accommodates the different coefficients of thermal expansion of the pane of glazing material 20 and the vinyl elongated member 12, thereby maintaining the adhesive bond between the pane of glazing material 20 and the vinyl elongated member 12 over a relatively broad temperature range.

The hollow members 22, 86 and the window pane retainers 26, 96 may be made of any one of a number of extrudable plastic materials, such as vinyl. In a typical application, the metal stiffeners 24, 84, have a width in the order of 0.78 inches and a thickness in the order of 0.06 inches. The metal stiffeners 24, 84 are proportioned to fit in the hollow members 22, 86 with a slight clearance between the metal stiffeners 24, 84 and the vinyl hollow members 22, 86. The length of the metal stiffeners is equal to the length of the hollow members 22, 86 which may be fabricated in various lengths to suit a range of variously sized window configurations.

Screws 102, 104, 106, 108, which are symbolically illustrated by the centerlines in FIG. 3, typically pass through the hollow member 22, the metal stiffener 24, and the corner gussett 60. In an alternative embodiment of the invention, which is not shown, the screws 102, 104, 106, 108 are eliminated and the elongated members 12, 14, 16, 18 are joined by welding or an adhesive.

FIG. 5 shows an alternative embodiment of the invention in which the metal stiffener 24 and the leg 58 of the corner gussett 60 are in substantial alignment. In the embodiment shown in FIG. 5, the metal stiffener 24 is slightly bent and as a result bears against adjacent portions of the elongated member 16 and is thereby retained in the elongated member 16.

FIG. 6 shows an alternative embodiment of the invention 22 in which a pair of window frame assemblies 202, 204 are mounted in a jamb assembly 206. The jamb assembly 206 is conventional in nature and need not be described in detail other than to indicate that the jamb assembly provides wall surfaces 208, 210, 212, 214 which provide a contact for the flexible weather strips 216, 218, 220, 222 which are mounted on the frame assemblies 202, 204 in recessed grooves 224, 226, 228, 230. The frame assemblies 202, 204 are generally similar to the frame assembly 10 and incorporate metal stiffeners 232, 234 which are mounted in a manner similar to that which has been previously described. The frame assemblies 202, 204 incorporate an alternative method of retaining the panes of glazing material 236, 238. In the frame assemblies, 202, 204 the elongated members 240, 242 each have a pair of spaced apart opposing walls 244, 246, 248, 250. Each of the opposing walls 244, 246, 248, 250 include a plurality of relatively soft durometer elastomeric strips 252. When the panes of glazing material 236, 238 are inserted between the opposing walls, the elastomeric strips 22 deflect and retain and seal the glazing material and the elongated members 240, 242.

Figure 7:
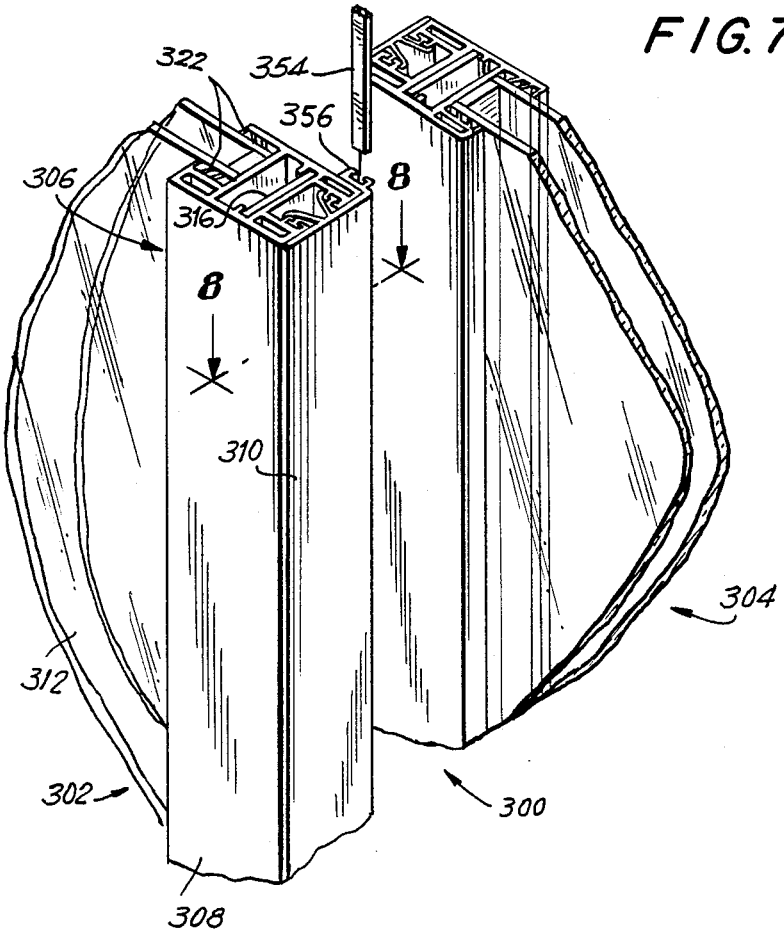
FIG. 7 is a fragmentary perspective view of still another alternative embodiment of the invention.
Figure 8:
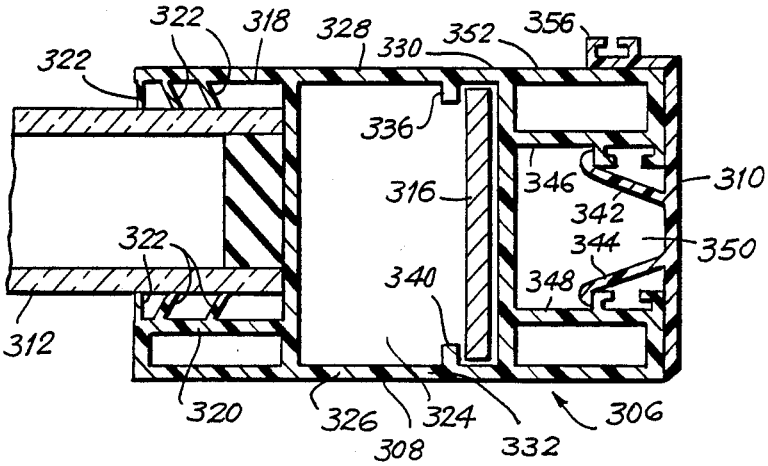
FIG. 8 is a cross-sectional view taken along the line 8—8 of FIG. 7.

FIGS. 7 and 8 show another embodiment of the invention 300 in which the invention is incorporated in a pair of sliding glass doors 302, 304 which may be found, for example, in an application such as a patio door. FIG. 7 shows a fragmentary perspective view of the glass door assembly 300. FIG. 8 shows a fragmentary cross-sectional view of one of the frame assemblies 306. The frame assembly 306 includes an elongated member 308, a cap member 310, a pane of glazing material 312, and a pair of metal stiffeners 314, 316. The two doors 302 and 304 are identical in construction and therefore only the frame assembly 306 of the door 302 will be described in detail.

As is best shown in FIG. 8, the elongated member 308 includes a pair of spaced apart opposing wall portions 318, 320. In the manner which has been previously described in connection with FIG. 6, the wall portions 318, 320 each include a plurality of relatively soft durometer elastomeric strips 322. When the pane of glazing material 312 is inserted between the opposing wall portions 318, 320, the elastomeric strips 322 deflect and retain and seal the pane of glazing material 312. The elongated member 308 includes a hollow portion 324 which is formed by the wall portions 326, 328, 330, 332. The wall portions 326, 328, 330, 332 include rib portions 336, 340. The rib portions 336, 340 retain the metal stiffener 316, which is similar to the metal stiffener 24 shown in FIG. 4.

The cap member 310 includes a pair of outwardly directed rib portions 342, 344 which are inserted between a pair of spaced apart wall portions 346, 348 of the elongated member 308. The cap 310 member closes the hollow space 350 on the elongated member 308. A recessed groove 356 is provided on the wall portion 352 in order to retain a strip of insulating material 354 as is shown in FIG. 7.

The ability of the window frame apparatus 10, according to the present invention, to withstand the forces imposed by high wind loads has been demonstrated during a series of structural tests performed on sample windows by an independent test laboratory, National Certified Testing Laboratories of York, Pa.

The following is a general description of the construction of the test window and the structural testing performed:

| | |
|---|---|
| TEST SPECIFICATION | ASTM D4099-82 Standard Specification for Poly (Vinyl Chloride) PVC Prime Windows |
| TEST SPECIMEN | Thermal Profiles Series SH-620 Single Hung Vinyl Prime Window (Grade 20) |
| OVERALL SIZE | 3'0" wide by 5'0" high |
| ACTIVE SASH SIZE | 2'10⅛" wide by 2'5½" high |
| GLAZING | Both sashes were interior glazed using sealed double insulating glass with a silicone bedding and a rigid vinyl glazing bead. The overall insulating glass thickness was 7/16" consisting of two lites of single strength annealed glass and one air space created by a desiccant filled aluminum spacer system. |

The test specimen without metal stiffeners was evaluated for conformance to the above specification and the structural results are summarized below:

| Type of Test | Test Results | Allowed |
|---|---|---|
| Uniform Load Structural | | |
| 30.0 psf Exterior | Meets Requirements | |
| 30.0 psf Interior | Meets Requirements | |
| Deglazing Test | | |
| Active Sash: | | |
| Meeting Rail (70#) | (0.019") 4% | <100% |
| Bottom Rail (70#) | (0.013") 3% | <100% |
| Left-Hand Stile (50#) | (0.010") 2% | <100% |
| Right-Hand Stile (50#) | (0.018") 4% | <100% |

The test specimen successfully met the performance specification requirements. A second larger specimen was tested as follows: The stiles of the active sash reinforced with a flat steel plate (0.78 inches wide×0.07 inches thick.

| | |
|---|---|
| TEST SPECIFICATION | ASTM D4099-82 Standard Specification for Poly (Vinyl Chloride) PVC Prime Windows |
| TEST SPECIMEN | Thermal Profiles Series SH-620 Single Hung Prime Window (Grade 30) |
| OVERALL SIZE | 3'8" wide by 5'0" high |
| ACTIVE SASH SIZE | 3'6⅛" wide by 2'5½" high |
| GLAZING | Both sashes were interior glazed using sealed double insulating glass with a silicone bedding and a rigid vinyl glazing bead. The overall insulating glass thickness was ½" consisting of two lites of single strength annealed glass and one air space created by a desiccant filled aluminum spacer system. |

The test specimen was evaluated for conformance to the above specification and the structural results are summarized below:

| Type of Test | Test Results | Allowed |
|---|---|---|
| Uniform Load Structural | | |
| 40.0 psf Exterior | Meets Requirements | |
| 40.0 psf Interior | Meets Requirements | |
| Deglazing Test | | |
| Active Rail (70#) | (0.037") 7% | <100% |
| Bottom Rail (70#) | (0.025") 5% | <100% |
| Left-Hand Stile (50#) | (0.024") 5% | <100% |
| Right-Hand Stile (50#) | (0.014") 3% | <100% |

The tests show that the addition of the reinforcing plate, or metal stiffener, increased the load which could be carried by the window from 30.0 to 40.0 psf, while allowing for the construction of a larger window.

While a preferred embodiment of the invention has been shown and described herein, it is obvious that numerous additions, changes and omissions may be made in such embodiments without departing from the spirit and scope of the invention.

What is claimed is:

1. A window frame apparatus comprising window pane means with said window pane means having a plurality of edges, a plurality of elongated members with said elongated members comprising wall portions forming a hollow portion, with said elongate members further comprising window pane mounting means for mounting said edges of said window pane means on said elongated members, a plurality of flat solid metal stiffener means with said stiffener means inserted respectively in said elongated members, and corner connection means for connecting the adjacent elongated members to form a frame for said window pane means.

2. A window frame apparatus according to claim 1 in which said stiffener means comprises an elongated metal strip.

3. A window frame apparatus according to claim 1 in which said elongated member further comprises wall portions forming a hollow portion for receiving said stiffener member means.

4. A window frame apparatus according to claim 1 in which said window pane comprises a plane surface and with a perpendicular to said plane surface defining the direction of maximum wind force on said window frame apparatus, with said stiffener means comprising a relatively thin metal strip having a flat surface defining a stiffener plane having a first, relatively strong direction of bending in a direction parallel to said stiffener plane, and a second, relatively weak direction of bending in a direction perpendicular to said stiffener plane, and with said elongated member means disposed to orient said stiffener means so that said strong direction of bending is directed to oppose said direction of maximum wind force, thereby minimizing deflection of said window frame apparatus due to wind forces.

5. A window frame apparatus according to claim 1 in which the length of said stiffener means is substantially equal to that of said elongated member means.

6. A window frame apparatus according to claim 1 in which said corner means comprises corner gussett means and receiving portions formed in said elongated member means for receiving said corner gussett means.

7. A window frame apparatus according to claim 1 in which said corner means comprises welding means.

8. A window frame apparatus according to claim 1 in which said corner means comprises adhesive means.

9. A window frame apparatus according to claim 1 in which said elongated member means is made of a plastic material.

10. A window frame apparatus according to claim 9 in which said elongated member is made of vinyl.

11. A window frame apparatus according to claim 1 in which said window pane has two surfaces and in which said window pane mounting means comprises a portion of said elongated member means disposed bearing on a first surface of said window pane and elongated strip means removably mounted on said elongated member means and disposed bearing of a second surface of said window pane.

12. A window frame apparatus according to claim 11 in which said elongated member means includes a portion having walls defining a groove and in which said elongated strip means includes a portion projecting into said groove.

13. A window frame apparatus comprising a pair of stiles and a pair of rails with said stiles and rails removably connected to define a window sash frame;

said stile and said rail members having substantially the same cross-sectional configuration throughout their longitudinal extent respectively;

said stile and said rail members each having a pair of generally parallel side walls, a first of said side walls being of greater height than a second of said side walls with a selected portion of said second side wall having a relatively greater thickness than the remaining portion of said second side wall;

said stile and said rail members having a second transverse wall spaced apart from and generally parallel to said first transverse wall;

said first and second side walls and said first and second transverse walls cooperating to form a hollow chamber;

a projecting rib formed on said first side wall and projecting into said hollow portion;

said projecting rib and said selected portion of said second side wall cooperating to define a partially enclosed chamber within said hollow portion; and flat metal stiffener means removably inserted into said partially enclosed chamber.

14. A window frame apparatus according to claim 13 further comprising an adhesive layer disposed on said first side wall.

15. A window frame apparatus according to claim 13 further comprising a plurality of corner gussett means with said corner gussett means each comprising a pair of leg members;

with a first of said leg members projecting into said partially enclosed chamber of one of said rail members; and with a second of said leg members projecting in said partially enclosed chamber of one of said stile members.

16. A window frame apparatus according to claim 15 further comprising at least one screw member projecting through said second transverse wall, said flat metal stiffener means and one of said leg members of said corner gussett means.

17. A window frame apparatus according to claim 16 in which said elongated member includes a portion having walls defining a groove and in which said elongated strip means includes a first portion disposed generally parallel to said window pane means, a second portion of said elongated strip means disposed generally perpendicular to said first portion of said elongated strip means, and a third portion of said elongated strip means disposed generally parallel to said first portion of said elongated strip means and with said third portion of said elongated strip means projecting into said groove.

* * * * *